United States Patent [19]

Fegeat

[11] 3,959,993

[45] June 1, 1976

[54] CIRCULAR PILE FABRIC KNITTING MACHINES

[76] Inventor: Antoine Gabriel (dit Tony) Fegeat, Route de la Serra, Calvi, France, 20

[22] Filed: Dec. 9, 1974

[21] Appl. No.: 530,969

[30] Foreign Application Priority Data

Dec. 10, 1973 France ..... 73.43887

[52] U.S. Cl. ..... 66/9 B; 19/145.7

[51] Int. Cl.[2] ..... D04B 9/14

[58] Field of Search ..... 66/9 B, 156; 19/105, 19/145.7

[56] References Cited

UNITED STATES PATENTS

| | | | |
|---|---|---|---|
| 2,964,932 | 12/1960 | Rose | 66/9 B |
| 3,122,904 | 3/1964 | Brandt | 66/9 B |
| 3,377,664 | 4/1968 | Keramas et al. | 19/105 |
| 3,427,829 | 2/1969 | Wiesinger | 66/9 B |
| 3,495,422 | 2/1970 | Miller | 66/9 R |
| 3,501,812 | 3/1970 | Schmidt | 66/9 B |
| 3,643,473 | 2/1972 | Strong | 66/155 |
| 3,685,315 | 8/1972 | Delberghe | 66/9 B |
| 3,709,002 | 1/1973 | Brandt et al. | 66/9 B |
| 3,859,823 | 1/1975 | Ellis | 66/9 B |
| 3,861,178 | 1/1975 | Kouklik et al. | 66/155 |

FOREIGN PATENTS OR APPLICATIONS

| | | | |
|---|---|---|---|
| 1,313,667 | 11/1962 | France | 19/105 |
| 1,600,794 | 7/1970 | France | 66/155 |
| 1,069,510 | 11/1959 | Germany | 19/105 |

*Primary Examiner*—Mervin Stein
*Assistant Examiner*—Andrew M. Falik
*Attorney, Agent, or Firm*—Nathan Levin

[57] ABSTRACT

A feeding device for each of the card units of the circular pile fabric knitting machines, characterised in that it comprises selective feed means for two types of fibers, either alternately with a predetermined output, or simultaneously with a delivery reduced by half for each of them, so that the mean density of the product obtained remains constant.

6 Claims, 1 Drawing Figure

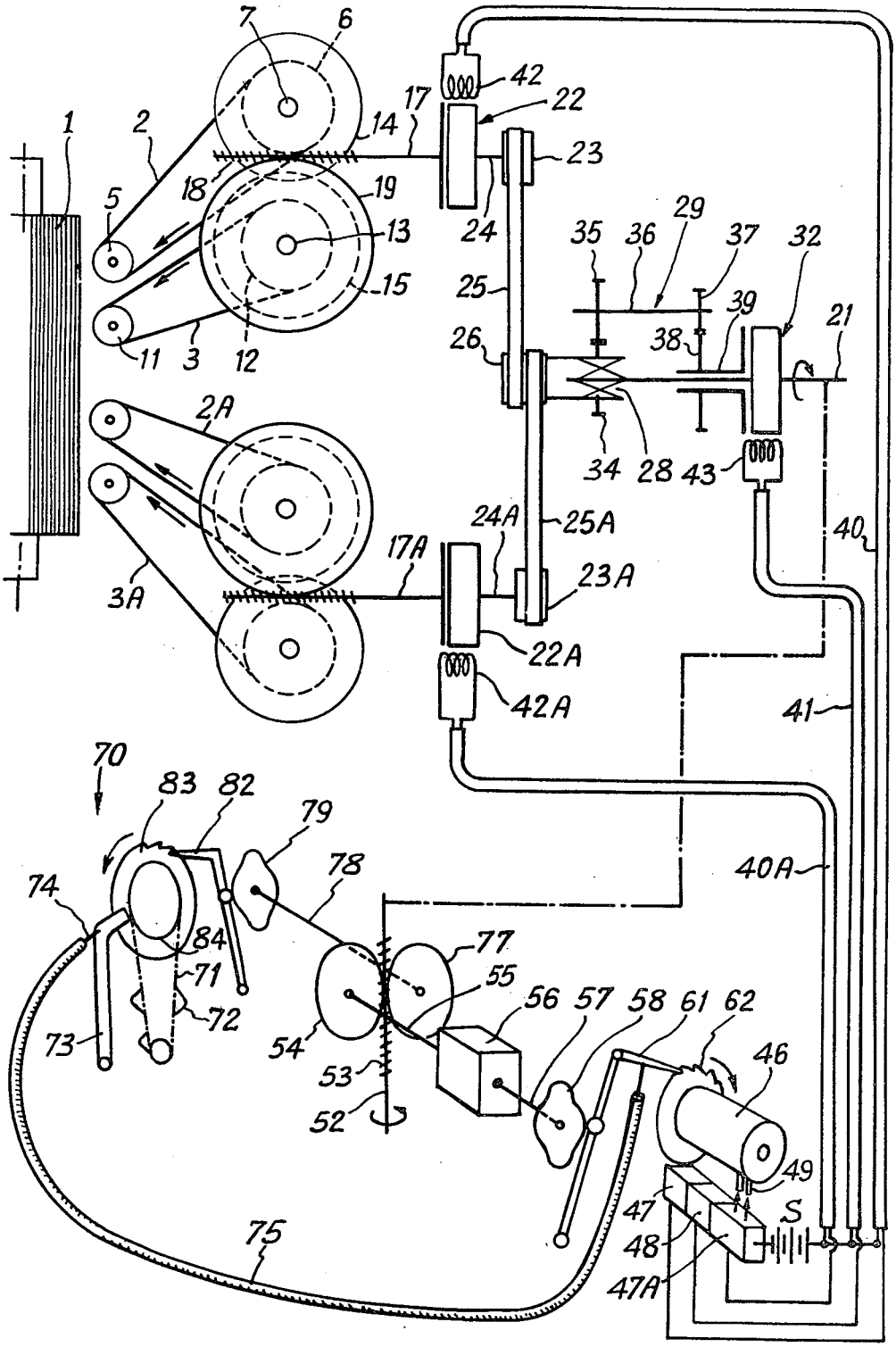
1
2
3
5
6
7
11
12
13
14
15
17
18
19
21
22
23
24
25
26
28
29
32
34
35
36
37
38
39
40
41
42
43
2A
3A
17A
22A
23A
24A
25A
42A
40A
70
71
72
73
74
75
77
78
79
82
83
84
46
47
47A
48
49
52
53
54
55
56
57
58
61
62
S

CIRCULAR PILE FABRIC KNITTING MACHINES

The present invention relates generally to the art of knitting and more particularly to high pile knitting machines having pattern controlled multiple sliver feeding means to form fabric having predetermined knit pile designs therein. Such knitting machines are provided with carding apparatus which presents fibers of the slivers to the needles of the machine while the pattern controlled multiple sliver feeding means acts to feed selected ones of the slivers to the carding apparatus. The present invention is directed to an improvement in pattern controlled multiple sliver feeding means for high pile knitting machines by means of which either one individually or a combination of both of a pair of separate slivers can be fed to the carding apparatus.

High pile circular knitting machines having carding apparatus and having pattern controlled multiple sliver feeding means are well known generally as shown in U.S. Pat. Nos. 2,964,932; 3,122,904; 3,495,422; 3,501,812 and 3,709,002, and to which reference may be made for an understanding of the kind of machines with which the apparatus of the present invention may be used.

In the present invention, each of separate pairs of endless belts are adapted to feed individual slivers to a pair of fluted rollers (which in turn feeds the slivers to the carding apparatus) when one or the other or both of the pairs of endless belts are caused to be advanced. Individual clutches, each under pattern control, cause the pairs of belts to be moved selectively by powder derived from a common drive shaft. Pattern controlled mechanism interposed between the drive shaft and such individual clutches acts to selectively cause either of the pairs of belts to move at a predetermined speed while the other pair of belts does not move or to cause both of the pairs of belts to move simultaneously at half the predetermined speed.

The present invention will be better understood by reference to the following detailed description of a preferred embodiment thereof taken in connection with the accompanying drawings which comprise:

A single FIGURE showing, in the upper portion thereof, the apparatus of the multiple sliver feeding means of the present invention, and showing, in the lower portion thereof, the means of the present invention for the pattern control of such apparatus.

In the drawings, a portion of one of a pair of conventional fluted cylinder is shown at 1, such cylinders normally acting to furnish slivers to a conventional card unit (not shown) having a main doffing cylinder and a doffer roll to present tufts of fibers from the slivers to the hooks of the needles of circular knitting machines. Such knitting machines generally have a multiple number of feeds with a pair of such fluted cylinders and a card unit at individual ones of the feeds of the machines.

The drawing of the fibers is effected between the pair of cylinders 1, and two pairs of endless belts 2, 3 and 2A, 3A, made of leather or elastomer. The two pairs of endless belts are destined to be fed with fibers of different characteristics, more especially of different colours. They are provided with means (not shown) to yieldingly urge them one against the other under a pressure which is preferably adjustable. Each belt is provided also, preferably, with means (not shown) for individual adjustment of its own tension.

The belt 2 passes over a downstream cylinder 5 and over an upstream cylinder 6 carried by a shaft 7. In a similar manner, the belt 3 passes over a downstream cylinder 11 and over an upstream cylinder 12 which is carried by a shaft 13. The two shafts 7 and 13 are connected by two identical toothed wheels 14, 15 in engagement and they are driven in rotaton by a shaft 17 which carries a worm 18 in engagement with a toothed wheel 19 fixed on the shaft 13.

The other two belts 2A, 3A are of the same structure and driven in the same manner as the two belts 2, 3. The elements relating to the two belts 2A and 3A are identified by the same reference numerals as those associated with the belts 2, 3, plus the letter "A".

The two shafts 17 and 17A can be made to rotate, either simultaneously at a speed "$v$" or selectively individually at a speed "$2v$" from a general drive shaft 21 through the medium of a transmission system which comprises a first individual clutch 22 associated with the shaft 17 and a second individual clutch 22A associated with the shaft 17A, an individual pulley 23 secured to the input shaft 24 of the clutch 22 and an individual pulley 23A secured to the input shaft 24A of the clutch 22A, a belt 25 which passes over the individual pulley 23 and over a common pulley 26 and a belt 25A which passes over the individual pulley 23A and over the same common pulley 26, a conventional overriding clutch 28 interposed between the common pulley 26 and the general drive shaft 21 with the driven part of clutch 28 integral with the pulley 26 and its driver part secured to shaft 21 to drive pulley 26 from shaft 21 and at the same time to permit pulley 26 to rotate about shaft 21 when it is driven at a higher rate of speed than the speed of shaft 21 by a train of multiplier gearwheels 29 interposed between the clutch 28 and the general drive shaft 21, through the medium of a common clutch 32. The train of gear-wheels 29 comprises a toothed wheel 34 integral with the driven part of the clutch which is itself integral with the common pulley 26, a toothed wheel 35 of the same number of teeth as that of the wheel 34, in engagement with this latter wheel and carried by a counter-shaft 36, a toothed wheel 37 fixed also on the counter-shaft 36 and a toothed wheel 38 in mesh with the wheel 37, of a number of teeth double the number of teeth of the wheel 37 and mounted idly, through the medium of a sleeve 39, on the general drive shaft 21 and with which it rotates when the common clutch 32 interposed between shaft 21 and sleeve 39 is energized.

The clutches 22, 22A and 32 are of the electromagnetic types of which the energizing coils are shown diagrammatically at 42, 42A and 43, respectively. These coils are fed selectively, from a source of current which has been shown symbolically at "S", through the medium of a control system schematised in the form of a drum 46 having contact studs 49 and of switches 47, 47A and 48 connected respectively to the coils 42, 42A, 43 by lines 40, 40A, 41. The contact studs 49 are placed on drum 46 according to a predetermined program.

The program drum 46 is driven from a shaft 52 connected to the general drive shaft 21 by a transmission which comprises a worm 53, a toothed wheel 54 in mesh with the worm and carried by the input shaft 55 of a gear-box 56 the output shaft 57 of which carries a cam 58 for actuation of a pawl 61 which cooperates with a ratchet wheel 62 secured to the drum 46. In the example shown, the installation includes mechanism 70 to control the indexing of drum 46 with a cam-carrying chain 71 the cams 72 of which are destined to move a lever 73 for actuating one end of an internal cable 74 of a flexible drive 75, the other end of which is connected to the pawl 61 for actuation of the program drum 46. The cam-carrying chain 71 is actuated also from the shaft 52 by a transmission which comprises a toothed wheel 77 also in engagement with the worm 53 and carried by a shaft 78 on which is fixed a cam 79 for actuation of a pawl 82 which cooperates with a ratchet wheel 83 integral with a toothed wheel 84 over which passes the cam-carrying chain 71.

There are three modes of operation of the apparatus of the present invention under control of drums 46 with shaft 21 rotating, and these will now be described.

In the first mode of operation the general clutch 32 is in engagement as well as the individual clutch 22, while the other individual clutch 22A is released, The shaft 17 for driving the belts 2 and 3 for the feed of the first type of fibers is driven at the speed $2v$ through the medium of the clutch 22, of the belt transmission 25 and of the train of multiplier gear-wheels 29 and clutch 28 which drives the pulley 26 at a speed twice as great as that of the shaft 21 on which it is mounted, while the shaft 17A remains stationary. The card unit of the knitting machine therefore receives only fibers of the first kind.

In transmission 25A second mode of operation : the general clutch 32 is still in engagement as well as the individual clutch 22A, but the individual clutch 22 is released. By the clutch 22A, the belt transmission25A, the train of multiplier gear-wheels 29 and clutch 28, the shaft 17A is driven at the speed $2v$ and drives the belts 2A and 3A at the corresponding speed for the feed of the fibers of the second group, while the fibers of the first group are not fed.

In the third mode of operation the common clutch 32 is not in engagement, while the two individual clutches 22 and 22A are in engagement. The general drive shaft 21 drives, via clutch 28 and pulley 26, the two belts 25, 25A and, consequently, by the two clutches 22 and 22A the shafts 17, 17A to drive the belts 2, 3, 2A, 3A to feed the two groups of fibers at a speed which corresponds to the speed "$v$" of the common pulley 26. The fibers of the two groups are therefore fed simultaneously with an output of each which is half the output of that with which they were fed individually, either in the first, or in the second mode of operation. The density of the manufactured product is therefore the same when only a single group or a combination of both groups of fibers is fed. In the third mode of operation, the train of gear-wheels 29 is running idle at low speed.

The selective feeding of the fibers of the first or of the second or of both groups is effected according to any program drawn up in advance through the medium of the drum 46 as a function of the location of the studs 49 placed on this drum and as a function also of the program determined by the cams 72 placed suitably on the chain 71. While the general drive shaft 21 functions and the fibers are fed, the drum 46 is driven step by step by its pawl drive 61 as described earlier. The chain 71 is advance by the pawl 82, also as indicated above. Each time that a cam 72 of the chain 71 raises the finger 73, the cable 74 of the flexible transmission 75 raises, in its turn, the pawl 61 so that drum 46 is not indexed for as long as the cam-carrying chain keeps the finger 73 raised.

When the finger 73 is not moved by a cam 72, it releases the cable 74 and the pawl 61 falls back onto the ratchet wheel 62, so that the cam 58 is then in a position to bring about a new advance of the drum 46.

With the present invention the high pile fabric may be knit with designs of vertical, diagonal, horizontal stripes, of shades, of beads and others, and, in combination with selections of needles, it may be knit with designs of squares, of checks, of tartans, etc . . .

It will be noted that the present invention is not limited to the embodiment shown, the fiber feeding belts may be replaced with suitably disposed fluted rollers or may be used with a plurality of pairs of fluted rollers 1, and with the clutches 22, 22A replaced with jogging motors each of which may be under the present pattern control.

I claim:

1. Selective sliver feeding apparatus for use with a circular high pile fabric knitting machine of the type having a carding unit adapted to feed fibers derived from slivers to the needles of the machine, said apparatus comprising first rotary members to feed a first sliver to said carding unit, second rotary members to feed a second sliver to said carding unit, a rotary drive shaft, a first drive means including a first clutch operatively related to said shaft and to said first feeding members to rotate the latter to feed said first sliver to said carding unit when said first clutch is activated, a second drive means including a second clutch operatively related to said shaft and to said second feeding members to rotate the latter to feed said second sliver to said carding unit when said second clutch is activated, an over-running clutch operatively related to and interposed between said shaft and said first and said second drive means whereby the latter are driven by said shaft acting through said over-running clutch to rotate said first and said second feeding members at a predetermined speed when their respective first and second clutches are activated thereby to feed said first and said second slivers to said carding unit at a predetermined rate of feed, and additional drive means including an additional clutch operatively related to and interposed between said shaft and said over-running clutch whereby a predetermined one of said first and second drive means is driven by said shaft acting through said additional drive means and through said over-running clutch to rotate its corresponding feeding members at a speed greater than said predepermined speed thereof when its corresponding clutch and said additional clutch are activated thereby to feed the corresponding one of said slivers to said carding unit at a rate of feed greater than said predetermined rate of feed thereof.

2. In the apparatus of claim 1 wherein said greater speed of said feeding members is twice said predetermined speed thereof, and wherein said greater rate of feed of said corresponding one of said slivers is twice said predetermined rate of feed thereof.

3. In the apparatus of claim 2, pattern means operatively related to said clutches in such manner as to selectively activate the same in at least three combinations thereof, in the first of which only said first and said second clutches are activated whereby said first and said second slivers are each caused to be fed to said carding unit at said predetermined rate of feed thereof, in the second of which only said first and said additional clutches are activated whereby only said first sliver is caused to be fed to said carding unit at twice said predetermined rate of feed thereof, and in the third of which only said second and said additional clutches are activated whereby only said second sliver is caused to be fed to said carding unit at twice said predetermined rate of feed thereof.

4. In the apparatus of claim 3 wherein said pattern means comprises an indexable drum, a pawl adapted to index said drum, and control means to interrupt the actuation of said drum by said pawl at predetermined times.

5. In the apparatus of claim 1 wherein each of said first and second rotary members comprises a pair of endless belts arranged to feed one of said slivers to said carding unit.

6. In the apparatus of claim 3 wherein said clutches are of the electro-magnetic type, and wherein said electro-magnetic clutches are selectively energized by said pattern means.

* * * * *